US010458294B2

(12) United States Patent
Woo et al.

(10) Patent No.: US 10,458,294 B2
(45) Date of Patent: Oct. 29, 2019

(54) VARIABLE VALVE DEVICE FOR ENGINE

(71) Applicants: Hyundai Motor Company, Seoul (KR); Kia Motors Corporation, Seoul (KR)

(72) Inventors: Soo Hyung Woo, Yongin-si (KR); Back Sik Kim, Osan-si (KR); Seung Kook Han, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/001,802

(22) Filed: Jun. 6, 2018

(65) Prior Publication Data

US 2019/0178117 A1 Jun. 13, 2019

(30) Foreign Application Priority Data

Dec. 12, 2017 (KR) ..... 10-2017-0170812

(51) Int. Cl.
*F01L 13/00* (2006.01)
*F01L 1/053* (2006.01)

(52) U.S. Cl.
CPC ..... *F01L 13/0042* (2013.01); *F01L 1/0532* (2013.01); *F01L 2013/0052* (2013.01); *F01L 2013/101* (2013.01)

(58) Field of Classification Search
CPC ..... F01L 2001/0473; F01L 1/08; F01L 1/46; F01L 2013/0052
USPC ..... 123/90.17, 90.18, 90.6
See application file for complete search history.

(56) References Cited

U.S. PATENT DOCUMENTS 4,404,937 A 9/1983 Lietermann
4,498,352 A * 2/1985 Hedelin ..... F01L 1/08 123/90.17
6,425,359 B2 7/2002 Fujii et al.
6,863,038 B2 * 3/2005 Yamauchi ..... F01L 1/022 123/90.16
7,409,938 B2 8/2008 Dengler
7,472,671 B2 1/2009 Elendt et al.
(Continued)

FOREIGN PATENT DOCUMENTS

DE 4230877 A1 4/1993
DE 10148243 A1 4/2003
(Continued)

*Primary Examiner* — Jorge L Leon, Jr.
(74) *Attorney, Agent, or Firm* — Morgan, Lewis & Bockius LLP

(57) ABSTRACT

A variable valve device for an engine, may include a camshaft; a movable cam device fitted over the camshaft to be slidable in an axial direction of the camshaft, and configured such that cams with at least two different cam profiles and a guide protruding portion are disposed along the axial direction of the camshaft; at least one shaft groove linearly processed to have a predetermined cross-sectional shape in an external circumferential surface of the camshaft along the axial direction thereof; a cam groove provided in an internal circumferential surface of the movable cam device to communicate with the shaft groove; and an insertion member inserted into a communication space defined by the shaft groove and the cam groove such that a rotational displacement of the camshaft is transmitted to the movable cam device.

4 Claims, 7 Drawing Sheets

(56) References Cited

U.S. PATENT DOCUMENTS

| | | | | |
|---|---|---|---|---|
| 7,762,225 | B2 | 7/2010 | Dengler | |
| 2005/0011480 | A1 | 1/2005 | Schultz et al. | |
| 2007/0178731 | A1 | 8/2007 | Elendt | |
| 2010/0108006 | A1 | 5/2010 | Elendt et al. | |
| 2010/0224154 | A1 | 9/2010 | Elendt et al. | |
| 2010/0251982 | A1 | 10/2010 | Elendt et al. | |
| 2011/0247577 | A1 | 10/2011 | Elendt et al. | |
| 2012/0006292 | A1 | 1/2012 | Elendt et al. | |
| 2012/0024245 | A1 | 2/2012 | Nendel | |
| 2015/0369089 | A1* | 12/2015 | Print | F01L 1/344<br>123/90.18 |
| 2016/0290185 | A1* | 10/2016 | Hofmann | F01L 13/0036 |
| 2017/0284241 | A1* | 10/2017 | Kataoka | F01L 1/022 |
| 2017/0321577 | A1* | 11/2017 | Junge | F01L 1/047 |
| 2018/0179921 | A1* | 6/2018 | Yano | F01L 1/185 |
| 2019/0032524 | A1* | 1/2019 | Franke | F01L 1/053 |
| 2019/0112950 | A1* | 4/2019 | Nitz | F01L 1/044 |

FOREIGN PATENT DOCUMENTS

| | | | |
|---|---|---|---|
| EP | 0798451 | A1 | 10/1997 |
| KR | 10-2014-0114497 | A | 9/2014 |
| KR | 10-1461899 | B1 | 11/2014 |
| KR | 10-1655221 | B1 | 9/2016 |

* cited by examiner

VARIABLE VALVE DEVICE FOR ENGINE

CROSS REFERENCE TO RELATED APPLICATION

The present application claims priority to Korean Patent Application No. 10-2017-0170812, filed Dec. 12, 2017, the entire contents of which is incorporated herein for all purposes by this reference.

BACKGROUND OF THE INVENTION

Field of the Invention

The present invention relates generally to a variable valve device for an engine. More particularly, the present invention relates to a technique for controlling a valve lift in a multi-stage manner.

Description of Related Art

An engine, which is an internal combustion engine, has a plurality of valves for introducing or discharging air into and out of the combustion chamber, and more efficient engine operation is achieved by varying the opening and closing behavior of the valves according to the operating conditions of the engine.

One way to vary the behavior of the valves for more efficient engine operation is to change the lift of the valves when the valves are opened. A device performing such an operation is conventionally referred to as a variable valve lift (VVL) device.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a variable valve device for an engine, in which the assembly accuracy of a variable valve lift device of an engine is improved, and the durability and operational stability of a camshaft is secured, whereby the operation of the variable valve device is performed more accurately and stably, and thus, it is possible to improve the output of an engine with more accurate engine control and is possible to increase the durability of the engine.

In various aspects of the present invention, there is provided a variable valve device for an engine, the variable valve device including: a camshaft; a movable cam device fitted over the camshaft to be slidable in an axial direction of the camshaft, and configured such that cams with at least two different cam profiles and a guide protruding portion are disposed along the axial direction of the camshaft; at least one shaft groove linearly processed to have a predetermined cross-sectional shape in an external circumferential surface of the camshaft along the axial direction thereof; a cam groove provided in an internal circumferential surface of the movable cam device to communicate with the shaft groove; and an insertion member inserted into a communication space defined by the shaft groove and the cam groove such that a rotational displacement of the camshaft is transmitted to the movable cam device.

Each of the shaft groove and the cam groove may be configured to have a semicircular cross section such that the communication space has a circular cross section; and the insertion member may include a rod with circular cross section being inserted into the communication space with the circular cross section defined by the shaft groove and the cam groove.

The shaft groove and the cam groove may be configured such that the communication space has a polygonal cross section; and the insertion member may include a rod with a cross section similar to the polygonal cross section defined by the shaft groove and the cam groove and being inserted into the communication space with the polygonal cross section.

The shaft groove may be provided in plural within a range where the external circumferential surface remains around the camshaft.

In various aspects of the present invention, there is further provided a variable valve device for an engine, the variable valve device including: a camshaft; a movable cam device fitted over the camshaft to be slidable in an axial direction of the camshaft, and configured such that cams with at least two different cam profiles and a guide protruding portion are disposed along the axial direction of the camshaft; a shaft protrusion configured to protrude in a direction perpendicular to the axial direction of the camshaft; and a cam groove linearly provided in an internal circumferential surface of the movable cam device along an axial direction of the movable cam device such that the shaft protrusion is inserted thereinto.

The camshaft may be provided with a shaft pit being grooved from a surface of the camshaft such that an end portion of the shaft protrusion is inserted thereinto and locked thereto; and the shaft protrusion may be configured such that the end portion thereof is inserted into and locked to the shaft pit.

The camshaft may be provided with a shaft hole formed through the camshaft such that a middle portion of the shaft protrusion is inserted thereinto and locked thereto; and the shaft protrusion may be configured such that the middle portion thereof is locked by the camshaft and opposite end portions thereof protrude from a surface of the camshaft.

In various aspects of the present invention, there is further provided a variable valve device for an engine, the variable valve device including: a camshaft; a movable cam device fitted over the camshaft to be slidable in an axial direction of the camshaft, and configured such that cams with at least two different cam profiles and a guide protruding portion are disposed along the axial direction of the camshaft; a shaft groove linearly processed to have a predetermined cross-sectional shape in an external circumferential surface of the camshaft along the axial direction thereof; a cam slider slidably inserted into the movable cam device to slide from the movable cam device in a direction perpendicular to the axial direction of the camshaft such that an end portion thereof is inserted into the shaft groove; and an elastic member configured to elastically support the cam slider toward the camshaft.

The movable cam device may be provided on an internal circumferential surface thereof with a cam pit to guide linear sliding movement of the cam slider; and the cam pit may be provided in a nose of each of the cams forming the movable cam device.

According to an exemplary embodiment of the present invention, since the assembly accuracy of a variable valve lift device of an engine is improved, and the durability and operational stability of a camshaft is secured, the operation of the variable valve device is performed more accurately and stably, and thus, it is possible to improve the output of an engine with more accurate engine control and is possible to increase the durability of the engine.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
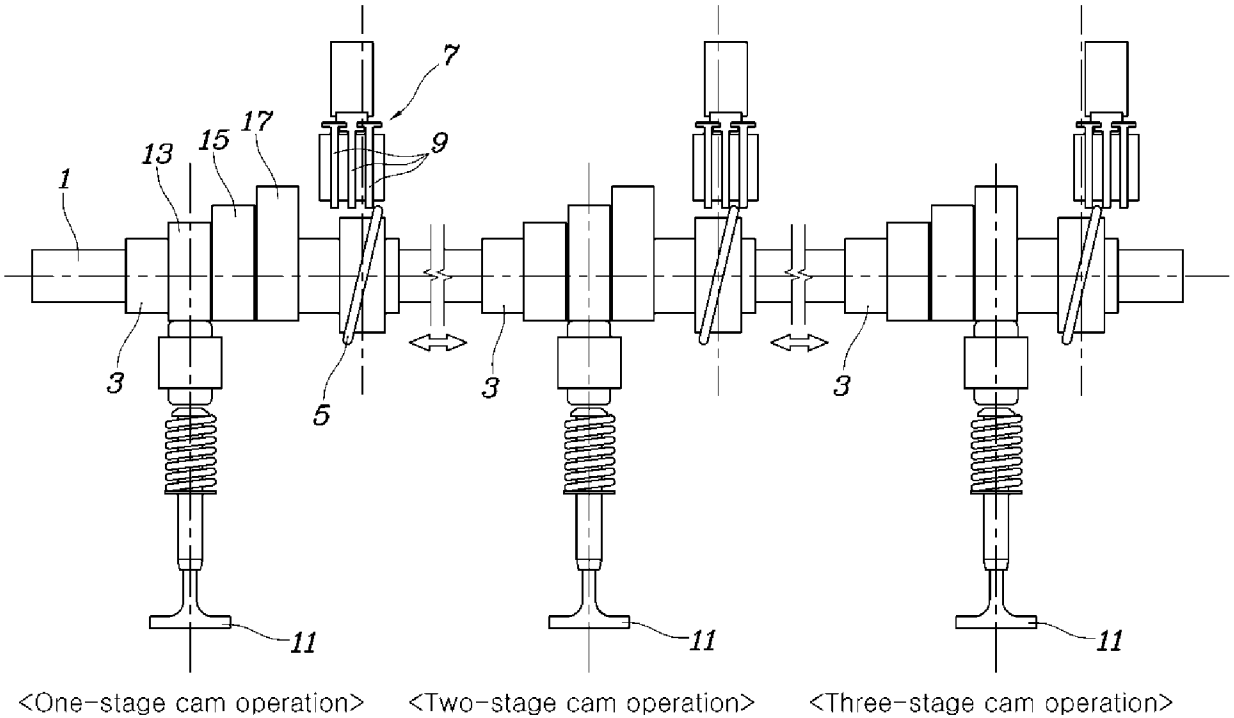
FIG. 1 is a view showing an operational principle of a variable valve device to which the present invention can be applied.
Figure 2:
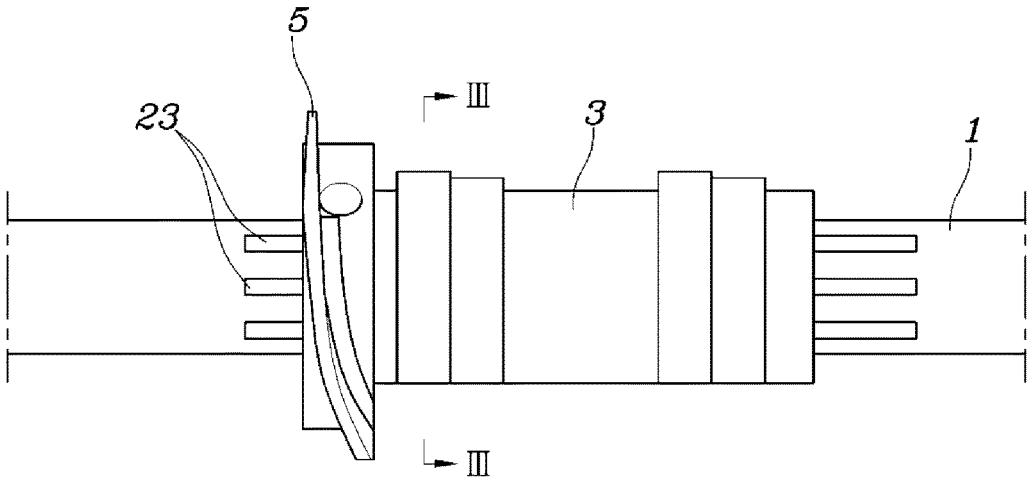
FIG. 2 is a view showing an important portion of a variable valve device for an engine according to an exemplary embodiment of the present invention.
Figure 3:
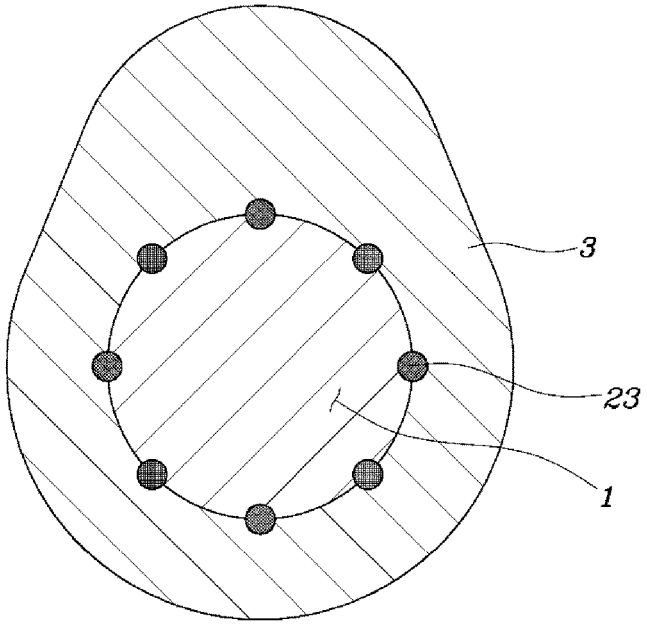
FIG. 3 is a sectional view taken along line III-III of FIG. 2.
Figure 4:
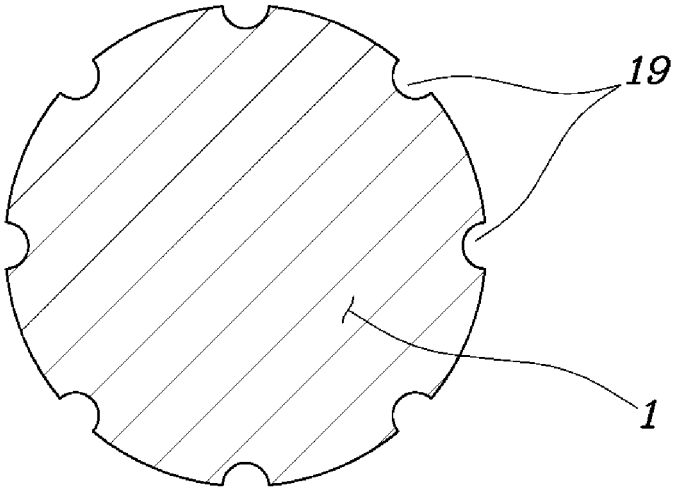
FIG. 4 is a sectional view showing a camshaft of FIG. 3.
Figure 5:
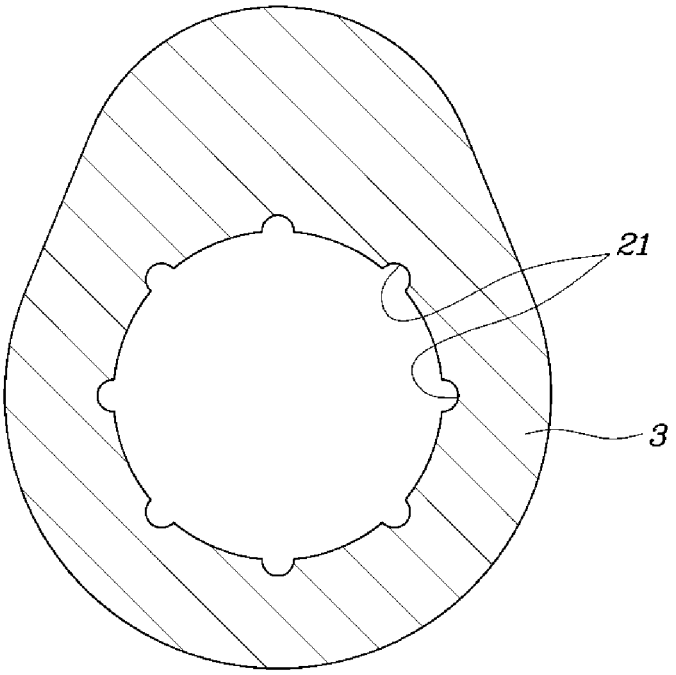
FIG. 5 is a sectional view showing a movable cam device of FIG. 3.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the contrary, the invention(s) is/are intended to cover not only the exemplary embodiments of the present invention, but also various alternatives, modifications, equivalents and other embodiments, which may be included within the spirit and scope of the invention as defined by the appended claims.

Hereinbelow, an exemplary embodiment of the present invention will be described in more detail with reference to the accompanying drawings.

FIG. 1 is a view showing an operational principle of a variable valve device for an engine to which the present invention may be applied.

A camshaft 1 is provided with a movable cam device 3 to be slidable in an axial direction of the camshaft 1, and the movable cam device 3 is provided with a guide protruding portion 5 such that the guide protruding portion 5 is guided by pins 9 of a variable actuator 7 according to protrusion of the pins 9 to be moved in the axial direction of the camshaft 1, whereby cams for opening or closing a valve 11 may be changed into one of a one-stage cam 13, a two-stage cam 15, and a three-stage cam 17.

As shown in the drawing, the one-stage cam 13, the two-stage cam 15 and the three-stage cam 17 have different maximum heights of noses, and as a result, the lift of the valve 11 may be varied, and the cams may be configured to have different valve opening or closing behaviors by configuring different cam profiles respectively.

As described above, the camshaft 1 and the movable cam device 3 may be configured for sliding in the axial direction thereof and be configured for transmitting the rotational force, and conventionally, they are coupled to each other by a spline or serration structure.

Referring to FIGS. 2 to 5, a variable valve device for an engine according to an exemplary embodiment of the present invention may include: a camshaft 1; a movable cam device 3 fitted over the camshaft 1 to be slidable in an axial direction of the camshaft, and configured such that cams with at least two different cam profiles and a guide protruding portion 5 are disposed along the axial direction of the camshaft 1; at least one shaft groove 19 linearly processed to have a predetermined cross-sectional shape in an external circumferential surface of the camshaft 1 along the axial direction thereof; a cam groove 21 provided in an internal circumferential surface of the movable cam device 3 to communicate with the shaft groove 19; and an insertion member 23 inserted into a communication space defined by the shaft groove 19 and the cam groove 21 such that a rotational displacement of the camshaft 1 is transmitted to the movable cam device 3.

In other words, in the state where the shaft groove 19 of the camshaft 1 and the cam groove 21 of the movable cam device 3 communicate with each other, the insertion member 23 is inserted into the communication space, whereby the movable cam device 3 is configured for sliding in the axial direction of the camshaft 1 and is configured for transmitting the rotational force.

As described above, when coupling the camshaft 1 and the movable cam device 3, if the structure of insertion of the insertion member 23 into the shaft groove 19 and the cam groove 21 of the present invention is applied without applying a serration or spline structure which is conventionally used, the accuracy of matching the rotation axis of the camshaft 1 and the rotation axis of the movable cam device 3 to the concentric axis may be greatly improved.

In other words, if the spline structure is applied to the external circumferential surface of the camshaft 1 and the internal circumferential surface of the movable cam device 3, the spline shape of the camshaft 1 is difficult to be processed to a predetermined radius from the rotation axis of the camshaft 1 due to the machining error, and in the case of the movable cam device 3, the spline shape is difficult to be processed to a predetermined radius from the rotation axis thereof. Thus, if the camshaft 1 and the movable cam device 3 with the above machining errors are coupled to each other, the errors are overlapped with each other and the rotation axis of the camshaft 1 and the rotation axis of the movable cam device 3 are difficult to form a concentric axis with each other, which lowers the operational accuracy and stability of the variable valve device, and as a result, it is disadvantageous to accurately control the opening or closing behavior of the engine valve 11, so that the performance of the engine cannot be fully exhibited, and the durability is also lowered.

However, according to an exemplary embodiment of the present invention, in the state where the external circumferential surface of the camshaft 1 and the internal circumferential surface of movable cam device 3 are processed to have circumferential surfaces which form a concentric axis, the shaft groove 19 and the cam groove 21 are processed, and the insertion member 23 is inserted therebetween, whereby basic alignment of the camshaft 1 and the movable cam device 3 is performed by contact between two circumferential surfaces which are easy to secure the machining precision, so that the rotation axis of camshaft 1 and the rotation axis of movable cam device 3 may be easily and precisely formed into the concentric axis, and accordingly, the operation of the variable valve device is performed more accurately and stably, and thus, it is possible to improve the output of an engine with more accurate engine control and is possible to increase the durability of the engine.

The shaft groove 19 may be provided in plural within a range where the circumferential surface remains around the camshaft 1, and the corresponding cam groove 21 may be provided in plural within a range where the circumferential surface remains inside the movable cam device 3, such that ultimately, with the movable cam device 3 inserted into the camshaft 1, the remaining circumferential surface of the camshaft 1 and the remaining circumferential surface of the movable cam device 3 are brought into contact with each other, whereby alignment of the camshaft 1 and the movable cam device 3 is secured by contact between two circumferential surfaces.

In other words, if one or more shaft grooves 19 is provided, it is possible to realize the function of the present invention. However, if too many shaft grooves 19 are formed on the circumferential surface of the camshaft 1, an effect of the concentric axis alignment by the circumferential surfaces cannot be expected, which is a situation that may be avoided. The present principle is also applied to the cam groove 21 formed on the internal circumferential surface of the movable cam device 3.

Furthermore, the camshaft 1 may be rotatably locked to a cylinder head by a cam cap. Of the camshaft 1, a journal, which is the part enclosed by the cam cap, cannot have a maximum diameter equal to or greater than the spline minimum root diameter of the camshaft 1 when the serration or spline is formed on the camshaft 1 as in the related art, so that the rigidity of the camshaft 1 is inevitably lower than that of the other parts. However, when the camshaft 1 and the movable cam device 3 are combined in the structure of the shaft groove 19, the cam groove 21, and the insertion member 23 as in the present embodiment, the diameter of the journal of the camshaft 1 may be realized with the maximum diameter of the camshaft 1, so it is possible to solve the problem of local rigidity degradation of the journal of the camshaft 1 occurring in the related art.

As described above, when rigidity degradation of the camshaft 1 by the journal is prevented, not only the durability of the camshaft 1 itself is improved but also the torsional deformation of the camshaft 1 is reduced so that the valves 11 of all the combustion chambers of the engine driven by the camshaft 1 are operated more accurately to improve the operability of the engine, and the durability is also improved.

Each of the shaft groove 19 and the cam groove 21 has a semicircular cross section such that the communication space has a circular cross section; and the insertion member 23 may include a rod with circular cross section being inserted into the communication space with circular cross section defined by the shaft groove 19 and the cam groove 21.

The cross section of the insertion member 23 having the rod with circular cross section is maximized within a range in which the insertion member may be easily inserted into the communication space defined by the shaft groove 19 and the cam groove 21, such that when the rotational force between the camshaft 1 and the movable cam device 3 is transmitted, the occurrence of clearance is minimized.

Figure 6:
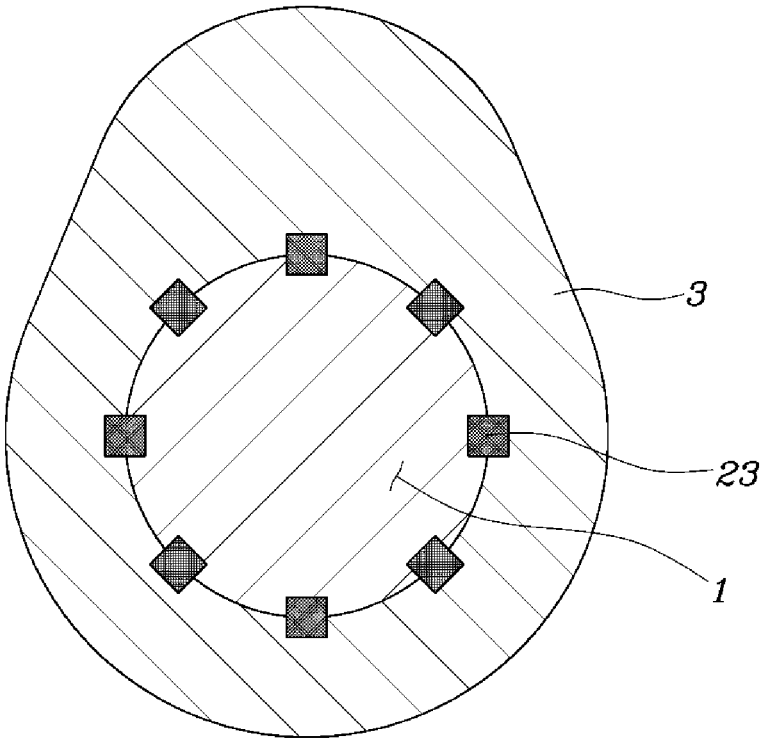
FIG. 6 is a sectional view showing a modification of an exemplary embodiment of the present invention.

FIG. 6 is a sectional view showing a modification of the various exemplary embodiments. When compared to FIG. 3, it is different in that the shaft groove 19 and the cam groove 21 are configured such that the communication space has a polygonal cross section; and the insertion member 23 may include a rod with a cross section similar to the polygonal cross section defined by the shaft groove 19 and the cam groove 21 and being inserted into the communication space with the polygonal cross section.

In FIG. 6, the shaft groove 19 and the cam groove 21 are configured such that the communication space has a quadrangular cross section, and accordingly, the insertion member 23 may include a rod with quadrangular cross section.

Figure 7:
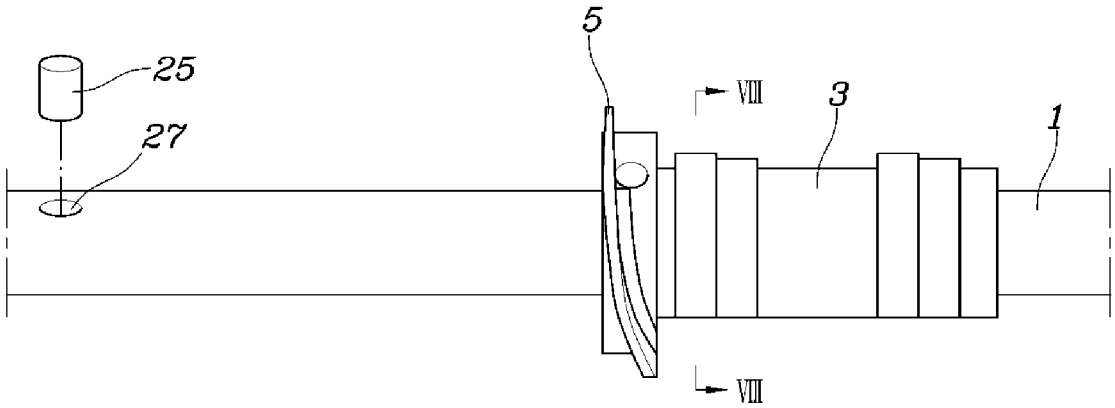
FIG. 7 is a view showing another exemplary embodiment of the present invention.

FIG. 7 is a view showing another exemplary embodiment of the present invention, wherein the exemplary embodiment of the present invention may include: the camshaft 1; the movable cam device 3 fitted over the camshaft to be slidable in an axial direction of the camshaft 1, and configured such that cams with at least two different cam profiles and the guide protruding portion 5 are disposed along the axial direction of the camshaft 1; a shaft protrusion 25 configured to protrude in a direction perpendicular to the axial direction of the camshaft 1; and the cam groove 21 linearly provided in the internal circumferential surface of the movable cam device 3 along an axial direction of the movable cam device such that the shaft protrusion 25 is inserted thereinto.

In other words, compared to the various exemplary embodiments of the present invention, it is similar in that the movable cam device 3 is provided with the cam groove 21, but instead of being provided with the shaft groove 19, the camshaft 1 is provided with the shaft protrusion 25 that protrudes to be inserted into the cam groove 21, such that not only the linear sliding of the movable cam device 3 with respect to the camshaft 1 is achieved, but also the rotational force transfer between the camshaft 1 and the movable cam device 3 is possible.

In the exemplary embodiment of the present invention, since the camshaft 1 and the movable cam device 3 are aligned with circumferential surfaces thereof being brought into contact with each other, it is easy to process and assemble the rotation axes thereof to form a concentric axis.

The camshaft 1 is provided with a shaft pit 27 being grooved from a surface of the camshaft 1 such that an end portion of the shaft protrusion 25 is inserted thereinto and locked thereto; and the shaft protrusion 25 is configured such that the end portion thereof is inserted into and locked to the shaft pit 27.

Figure 8:
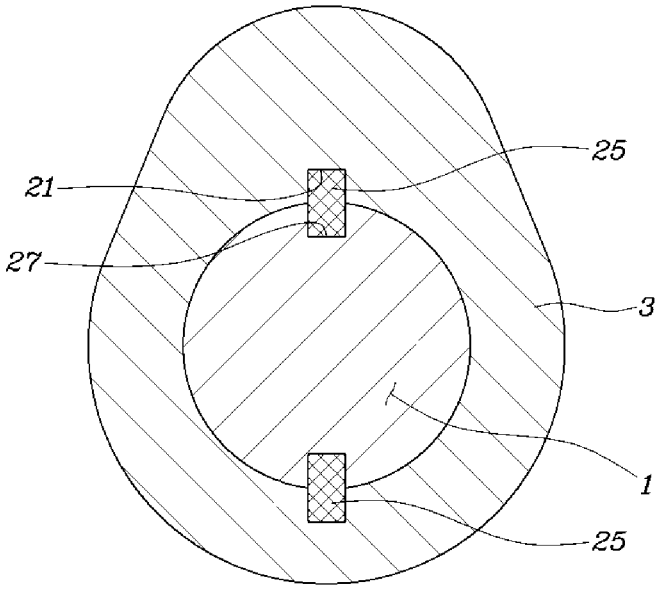
FIG. 8 is a sectional view taken along line VIII-VIII of FIG. 7.

FIG. 8 is a sectional view taken along line VIII-VIII of FIG. 7, wherein the shaft pit 27 is provided respectively at upper and lower portions of the camshaft, and the shaft protrusion 25 is inserted into the corresponding shaft pit.

Figure 9:
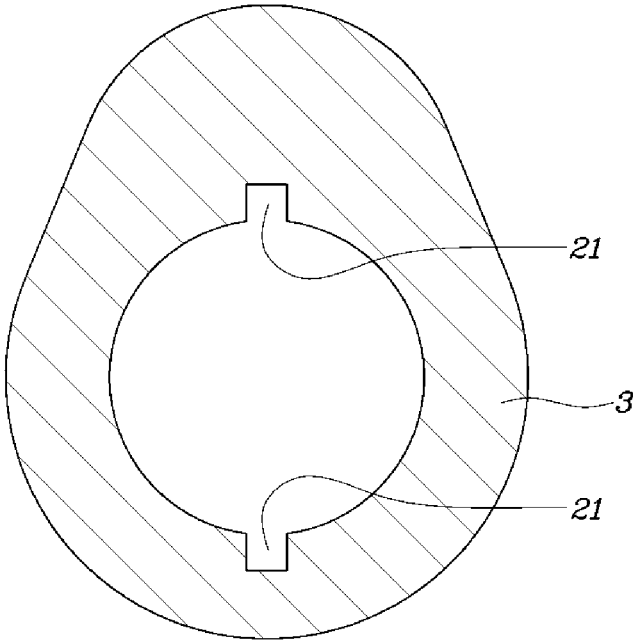
FIG. 9 is a sectional view showing a movable cam device of FIG. 8.

FIG. 9 shows a state where the cam groove 21 is provided in the movable cam device of FIG. 8.

The number of shaft pits 27, shaft protrusions 25, and cam grooves 21 may be at least one, and it does not need to be two.

Figure 10:
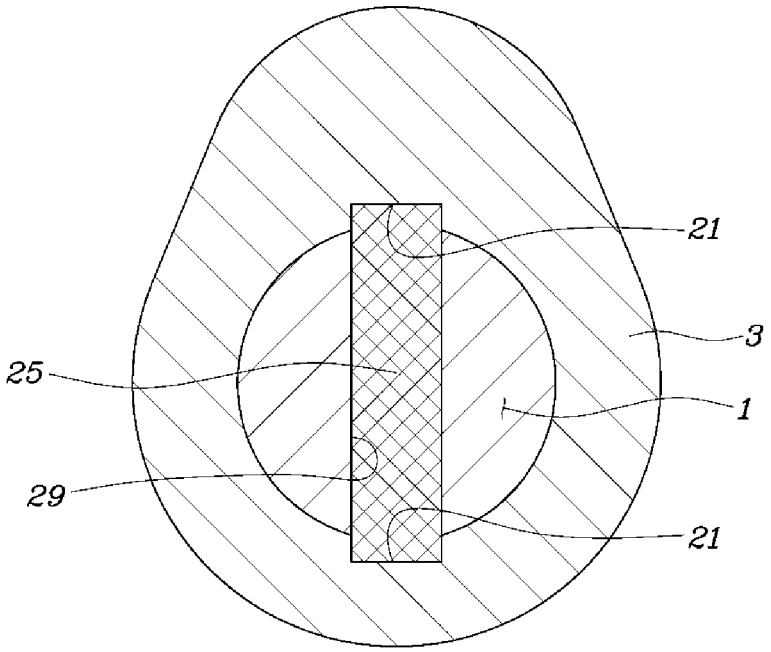
FIG. 10 is a sectional view showing a modification of an exemplary embodiment of the present invention.

FIG. 10 is a sectional view showing a modification of the above embodiment, wherein the camshaft 1 is provided with a shaft hole 29 formed through the camshaft 1 such that a middle portion of the shaft protrusion 25 is inserted thereinto and locked thereto; and the shaft protrusion 25 is configured such that the middle portion thereof is locked by the camshaft 1 and opposite end portions thereof protrude from a surface of the camshaft 1.

Accordingly, the shaft hole 29 may be formed by a single punching operation rather than forming the shaft pit 27 in two locations of the camshaft 1, and by inserting one shaft protrusion 25, it is possible to transmit the rotational force to the movable cam device 3 at the upper and lower portions.

Figure 11:
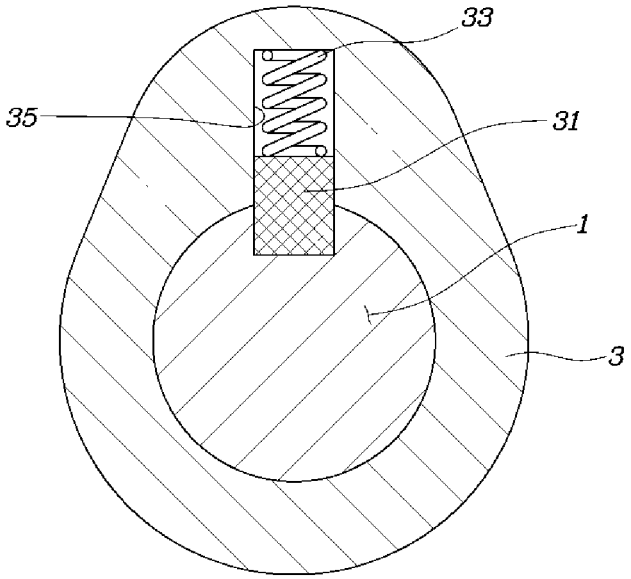
FIG. 11 is a sectional view showing another exemplary embodiment of the present invention.

FIG. 11 is a sectional view showing another exemplary embodiment of the present invention, according to the exemplary embodiment of the present invention, a variable valve device for an engine may include: the camshaft 1; the movable cam device 3 fitted over the camshaft to be slidable in an axial direction of the camshaft 1, and configured such that cams with at least two different cam profiles and the guide protruding portion 5 are disposed along the axial direction of the camshaft 1; the shaft groove 19 linearly processed to have a predetermined cross-sectional shape in an external circumferential surface of the camshaft 1 along the axial direction thereof; a cam slider 31 slidably inserted into the movable cam device 3 to slide from the movable cam device 3 in a direction perpendicular to the axial direction of the camshaft 1 such that an end portion thereof is inserted into the shaft groove 19; and an elastic member 33 configured to elastically support the cam slider 31 toward the camshaft 1.

Figure 12:
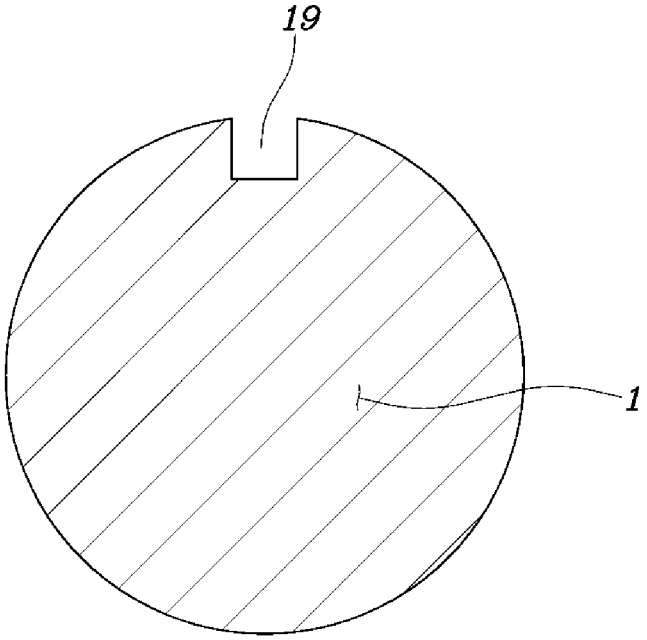
FIG. 12 is a sectional view showing a camshaft of FIG. 11.

In other words, as shown in FIG. 12, the camshaft 1 is provided with the shaft groove 19 linearly formed to be long in the axial direction thereof, the movable cam device 3 is provided with a cam pit 35, and the cam slider 31 and the elastic member 33 are disposed, so that the movable cam device 3 may be easily inserted and assembled in the camshaft 1 with the elastic member 33 being compressed. Once assembly is completed, the rotational force from the camshaft 1 may be transmitted to the movable cam device 3 while guiding the axial sliding of the movable cam device 3 with respect to the camshaft 1 by the cam slider 31 and the shaft groove 19.

The movable cam device 3 is provided on an internal circumferential surface thereof with the cam pit 35 to guide linear sliding movement of the cam slider 31, and the cam pit 35 is provided in a nose of each of the cams forming the movable cam device 3, such that a space sufficient to install the cam slider 31 and the elastic member 33 is secured.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve device for an engine, the variable valve device comprising:

a camshaft;

a movable cam device including a movable camshaft fitted over the camshaft to be slidable in an axial direction of the camshaft, wherein cams with at least two different cam profiles and a guide protruding portion are disposed on the movable camshaft along the axial direction of the camshaft;

at least one shaft groove linearly processed on the camshaft to have a predetermined cross-sectional shape in an external circumferential surface of the camshaft along the axial direction of the camshaft;

at least one cam groove provided in an internal circumferential surface of the movable cam device to communicate with the at least one shaft groove; and an insertion member inserted into a communication space defined between the at least one shaft groove and the at least one cam groove, wherein a rotational displacement of the camshaft is transmitted to the movable cam device by the insertion member, wherein each of the at least one shaft groove and the at least one cam groove has a semicircular cross section, and the communication space has a circular cross section, and wherein the insertion member includes a rod with a circular cross section and being inserted into the communication space.

2. The variable valve device of claim 1, wherein the at least one shaft groove is provided in plural and spaced with each other around the external circumferential surface of the camshaft.

3. A variable valve device for an engine, the variable valve device comprising:

a camshaft, a movable cam device including a movable camshaft fitted over the camshaft to be slidable in an axial direction of the camshaft, wherein cams with at least two different cam profiles and a guide protruding portion are disposed on the movable camshaft along the axial direction of the camshaft;

at least one shaft groove linearly processed on the camshaft to have a predetermined cross-sectional shape in an external circumferential surface of the camshaft along the axial direction of the camshaft;

at least one cam groove provided in an internal circumferential surface of the movable cam device to communicate with the at least one shaft groove; and an insertion member inserted into a communication space defined between the at least one shaft groove and the at least one cam groove, wherein a rotational displacement of the camshaft is transmitted to the movable cam device by the insertion member, wherein the at least one shaft groove and the at least one cam groove are configured to form the communication space having a polygonal cross section, and wherein the insertion member includes a rod with a cross section corresponding to the polygonal cross section defined between the at least one shaft groove and the at least one cam groove and being inserted into the communication space having the polygonal cross section.

4. The variable valve device of claim 3, wherein the at least one shaft groove is provided in plural and spaced with each other around the external circumferential surface of the camshaft.

* * * * *